United States Patent [19]

Hastings et al.

[11] Patent Number: 4,528,553

[45] Date of Patent: Jul. 9, 1985

[54] EVENT DETECTION APPARATUS

[75] Inventors: Ray D. Hastings, Los Alamos, N. Mex.; Ernest W. Boyer, Ponca City, Okla.

[73] Assignee: Conoco Inc., Ponca City, Okla.

[21] Appl. No.: 524,015

[22] Filed: Aug. 16, 1983

[51] Int. Cl.[3] ..... G08B 23/00

[52] U.S. Cl. ..... 340/526; 340/500; 340/507; 340/529

[58] Field of Search ..... 340/526, 500, 510, 511, 340/523, 529, 507, 527, 512, 588

[56] References Cited

U.S. PATENT DOCUMENTS

| | | | |
|---|---|---|---|
| 3,831,039 | 8/1974 | Henschel | 340/526 |
| 3,979,740 | 9/1976 | Forbat et al. | 340/529 |
| 4,086,574 | 4/1978 | Miyabe | 340/529 |

*Primary Examiner*—Donnie L. Crosland
*Attorney, Agent, or Firm*—William J. Miller

[57] ABSTRACT

Circuitry for qualifying a series of randomly occurring alarm events to avoid erroneous indications. Alarm events occurring in a surveillance system or the like are counted over a selected time interval, and final alarm output is effected only if a selected 1+n number of events has been counted within the interval. Both the repetitive time intervals and the event number are variable in accordance with the exigencies of the alarm application.

6 Claims, 2 Drawing Figures

EVENT DETECTION APPARATUS

BACKGROUND OF THE INVENTION

1. Field of the Invention

The invention relates to an electronic circuit for correlated event detection and, more particularly, but not by way of limitation, it relates to improved circuitry for reducing the probability of false alarm indications and increasing reliability of motion detector and other surveillance systems.

2. Description of the Prior Art

Applicants are aware of no prior art which performs the specific function of improving the integrity of an unattended, remote intrusion detection system by eliminating statistical random or false event indications.

SUMMARY OF THE INVENTION

The present invention relates to a logic circuit for analysis of event indications, instantaneous in nature, which is adjustable to evaluate a plurality of event indications over a selected time period. The circuit yields an output indication when 1+n events occur within a selectable duration. Event indications as derived from such as a motion detector or other alarm detector device are input to the circuit and a comparator qualifies the event number input in accordance with an adjustable events select control. The qualified event indication is then output to a comparator which also receives a time duration input, and the comparator with selected time duration and event input provides output of the qualifying indications for record, alarm or the like.

Therefore, it is an object of the present invention to provide output processing circuitry for alarm detectors and the like which exhibits increased reliability.

It is also an object of the present invention to construct a security system circuit which has inherently high noise immunity.

It is still further the object of the present invention to provide a reliable yet relatively low cost motion detector response circuit having high reliability.

Finally, it is an object of the invention to provide an alarm detection circuit that will not give false alarm to such as storm interference and other spurious interruptions.

Other objects and advantages of the invention will be evident from the following detailed description when read in conjunction with the accompanying drawings which illustrate the invention.

DETAILED DESCRIPTION OF THE INVENTION

Figure 1:
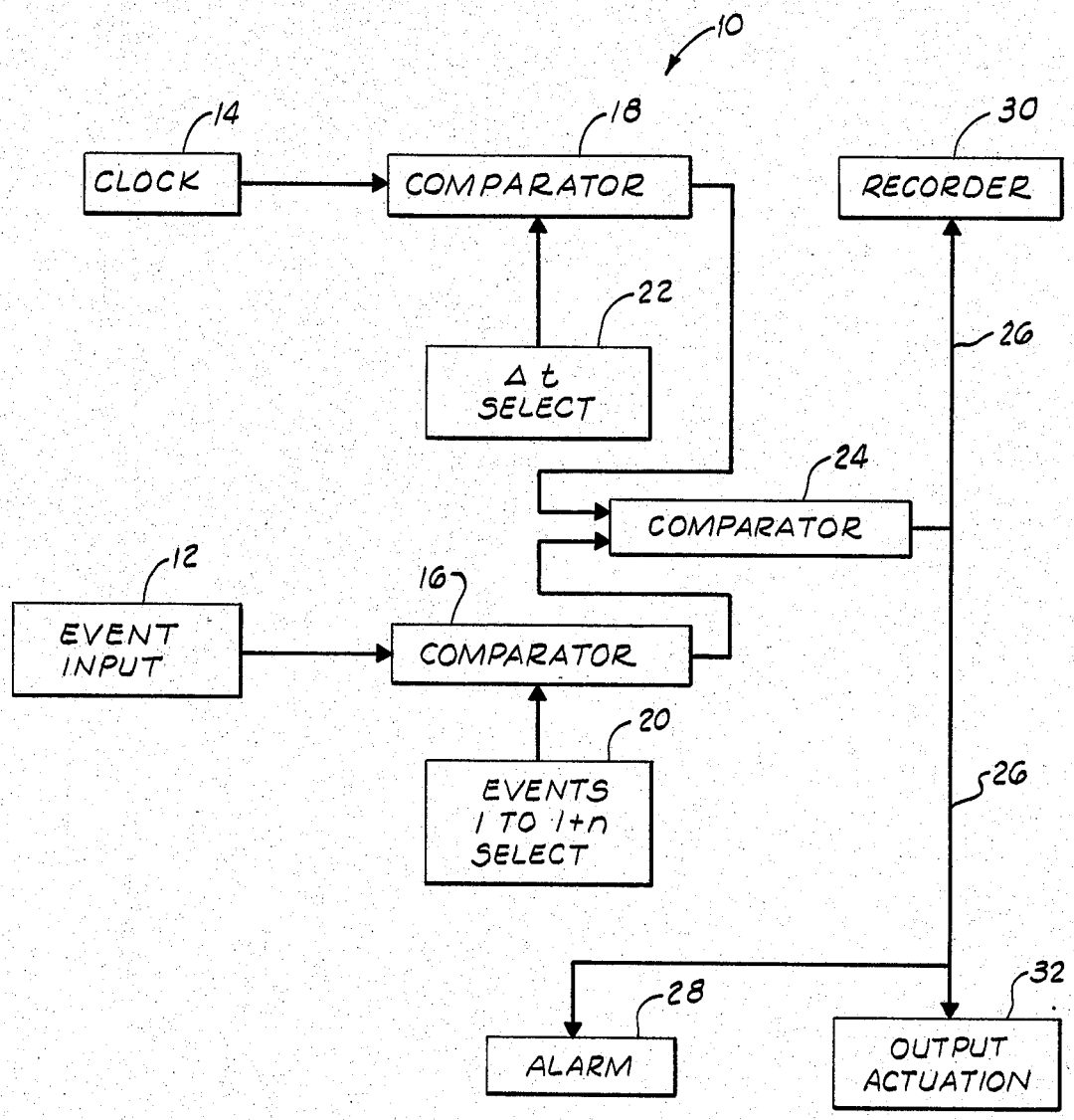
FIG. 1 is a block diagram of the event detection circuit of the present invention.

Referring to FIG. 1, an event detection circuit 10 includes an event input 12 and a clock circuit 14 providing input to respective comparator circuits 16 and 18. The comparator 16 is controlled to provide an output after a plurality of 1 to 1+n events as selected by events select stage 20. The output from comparator 18 in the form of a duration gate is controlled by a Δt select circuit 22. The Δt output from comparator 18 and the events output from comparator 16 are then input to a comparator 24 which provides a further qualified output on line 26 to an alarm device 28, recorder 30 or other output actuation 32.

Figure 2:
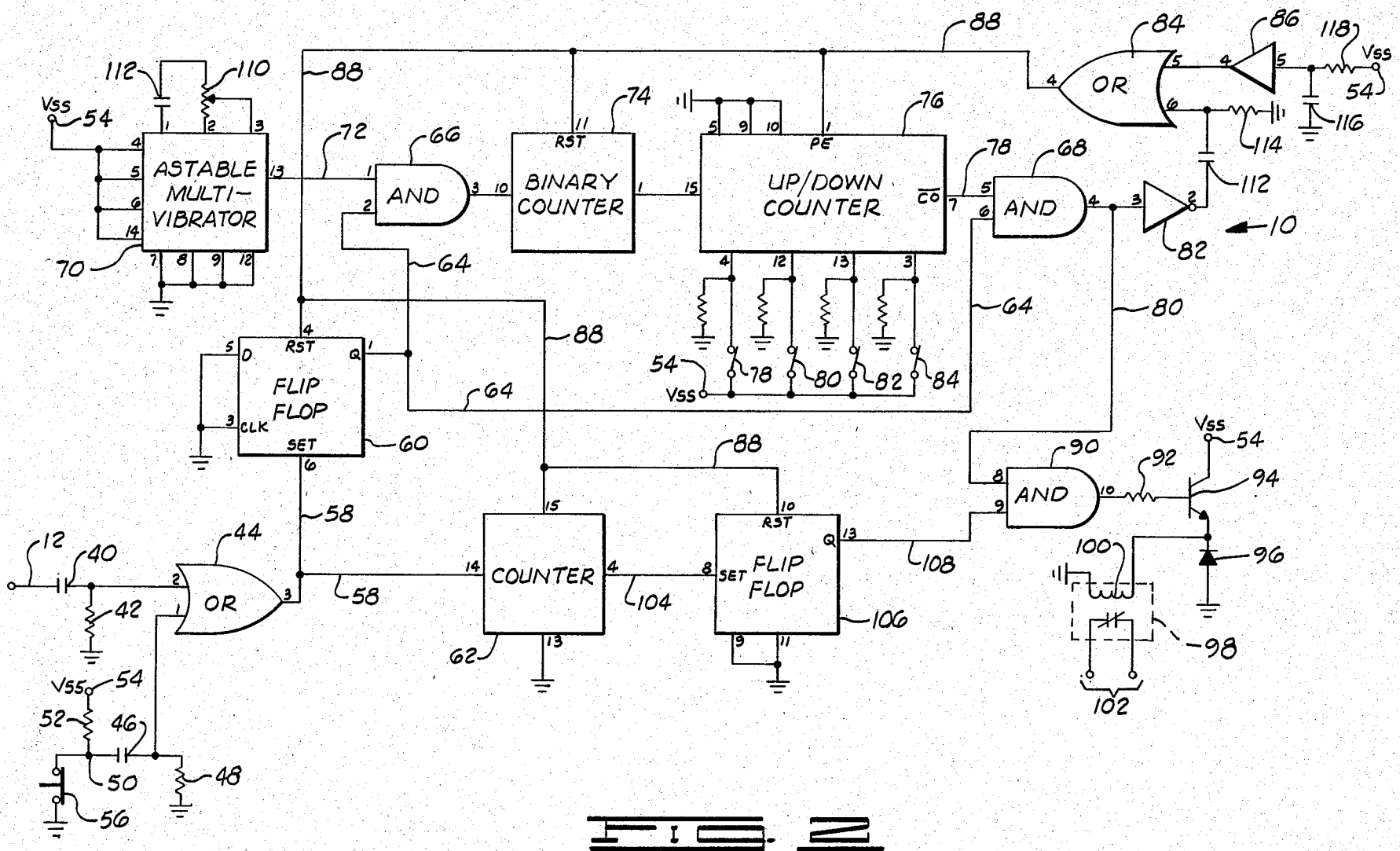
FIG. 2 is a schematic diagram of the event detection circuit of FIG. 1.

FIG. 2 illustrates the event detection circuit 10 in greater detail. The circuitry is complementary symmetry metal-oxide semiconductor (CMOS) and thereby enjoys the advantage of low power consumption and inherently high noise immunity. The integrated circuit pin numbers and function connections are indicated on FIG. 2, and the IC Type numbers will be recited hereinafter.

Event input 12 is applied to a capacitor 40 and common-connected resistor 42 to one input of an OR gate 44, IC Type 4071. A remaining input to OR gate 44 is from a capacitor 46 and common-connected resistor 48 connected to a junction 50. Junction 50 is connected through a voltage dropping resistor 52 to the voltage supply 54 as well as through a normally closed switch 56 to common.

Output from OR gate 44 is present on lead 58 to the SET input of a flip flop 60 as well as for input to a decade counter 62, IC Type 4017. The flip flop 60 is a D-Type flip flop, IC Type 4013, and the decade counter 62 is IC Type 4017. The Q output of flip flop 60 is present on lead 64 as applied to respective inputs of AND gates 66 and 68.

Basic clock frequency is generated in an astable multivibrator 70, an IC Type 4047 connected as illustrated and providing a 273 Hz output signal on lead 72 through AND gate 66 for input to a binary counter/divider 74. The binary counter is an IC Type 4020. The output of counter 74 is then input at Pin 15 to up/down counter 76, an IC Type 4029. The switches 78, 80, 82 and 84 enable selective control of the jam inputs of up/down counter 76 and count output is via lead 78 through AND gate 68.

Output from AND gate 68 on lead 80 is applied through an inverter 82 (IC Type 4049) to an OR gate 84. OR gate 84 is enabled by an inverter 86 (IC Type 4049) coupled to the supply voltage 54, and the output from OR gate 84 on lead 88 is the system RESET voltage as applied to the various synchronized counting circuits. Output from AND gate 68 on lead 80 is also applied through an AND gate 90, IC Type 4081 which provides output connection through resister 92 to the base of an NPN transistor 94 connected common-emmiter through a diode 96 and a parallel-connected output relay 98. Thus, conduction of transistor 94 energizes coil 100 of relay 98 to provide output indication across terminals 102.

The event counter 62, a decade counter, provides output on lead 104 to the SET input of a flip flop 106, a D-Type flip flop of IC Type 4013, and Q output from flip flop 106 on lead 108 is applied as the second input for coincidence through AND gate 90. The count output of event counter 62 is illustrated in FIG. 2 as the pin No. 4 or two-count event output. This is selectively varied by connecting other output pins that provide decoded output in response to pulse count as follows:

| Pin No. | Pulse Count |
|---|---|
| 1 | 5 |
| 2 | 1 |
| 5 | 6 |
| 6 | 7 |
| 7 | 3 |
| 9 | 8 |
| 10 | 4 |

-continued

| Pin No. | Pulse Count |
|---|---|
| 11 | 9 |

In operation, circuit test may be effected by opening switch 56 thereby allowing capacitor 46 to charge up to the supply voltage value, such test voltage then being present on pin 1 input to OR gate 44. During normal operation, switch 56 is closed to keep capacitor 46 discharged, and this will then allow any event signals appearing at event input 12 to be properly detected through capacitor 40 to pin number 2 of OR gate 44. The resistance-capacitance time constant of capacitor 40 and resistor 42 serve to delay the transition times of high frequency event signals thereby to ensure detection by the event counter 62.

Event output from OR gate 44 actuates the flip flop 60 which then places SET output on lead 64 to enable AND gates 66 and 68. Thus, the occurrence of the first event pulse initiates an interval of selected duration during which the detection of 1+n such event pulses will provide an alarm indication. After the interval of selected duration, a RESET occurs and the time reference pulses are again inhibited until the next event signal initiates the next sampling interval.

The astable multivibrator 70 provides the clock or time reference output through AND gate 66, when enabled, to the 14-stage binary counter 74. The frequency of multivibrator 70 is controlled by a potentiometer 110 and capacitor 112. The time reference pulses applied through AND gate 66 are divided down by 4096 in counter 74 and the resultant pulse output drives the clock input of counter 76. The jam inputs of counter 76 are controlled by switches 78–84 to allow selection of 0–135 second sample intervals as provided in 15 second increments. The carry output from counter 76 on lead 78 is then gated through AND gate 68, flip flop 60 Q output having been set, to provide a high enabling input to AND gate 90. The decade counter 62 is actuated by event indication on lead 58 and serves to set the Q output of flip flop 106 on the 1+n detected event, causing the output of AND gate 90 to go high if the interval timer has not completed its time sequence and lead 80 presents high. This, in turn, brings about conduction of the NPN transistor 94 to energize the coil 100 of relay 98. Resistor 92 limits the emmitter-to-base current of transistor 94 while the diode 96 suppresses the induced voltage that results from the collapsing magnetic field when the relay re-energizes.

The RESET circuit includes inverters 82 and 86 as they function with OR gate 84. The OR gate 84 permits the circuit RESET signal to originate from either the interval timer or the power up RESET circuit. RESET occurs from the timer circuit when the carry output on lead 78 goes low to signal the time out condition. The transition output of inverter 82 is then coupled through a capacitor 112 generating a reset pulse whose duration is a function of the time constant of capacitor 112 and resistor 114. Alternatively, as power is initially applied to the circuit, the RESET pulse originates from inverter 86 where the pulse duration is dependent on the charge time of capacitor 116 through resistor 118 as it rises up to the input threshold voltage of inverter 86. Once capacitor 116 is sufficiently charged, the inverter 86 enables OR gate 84 and all subsequent RESET pulses are generated as a function of the interval timer and inverter 82.

Changes may be made in combination and arrangement of elements as heretofore set forth in the specification and shown in the drawings; it being understood that changes may be made in the embodiments disclosed without departing from the spirit and scope of the invention as defined in the following claims:

The embodiments of the invention in which an exclusive property or privilege is claimed are defined as follows:

1. Apparatus for developing an event and time variable electrical signal alarm indication, comprising:

means responsive to a selected surveillance condition to produce one or more random event signals;

first counter means receiving said event signals at the input and producing an event count output upon receiving a selected number 1+n of said event signals;

clock means outputting time reference pulses;

flip flop means energized by the first one of said event signals to produce a set output;

gate means receiving time reference pulses and enabled by said set output to output said time reference pulses;

second counter means counting said gated time reference pulses and producing an enabling pulse for a selected duration;

AND gate means enabled by said selected duration enabling pulse from said second counter means to output any event count output from said first counter means; and alarm means responsive to said event count output.

2. Apparatus as set forth in claim 1 wherein said first counter means comprises:

decade counter means receiving input of said event signals and providing a pulse output after count of 1+n event signals; and second flip flop means receiving set input of said pulse output to provide said event count output.

3. Apparatus as set forth in claim 1 wherein said second counter means comprises:

binary counter means receiving said gated time reference pulses and providing a divided count output;

up/down counter means actuated by said divided count output and generating a carry output of selected duration; and second AND gate means enabled by said flip flop means set output to conduct said carry output as said selected duration enabling pulse to said AND gate means.

4. Apparatus as set forth in claim 2 wherein said second counter means comprises:

binary counter means receiving said gated time reference pulses and providing a divided count output;

up/down counter means actuated by said divided count output and generating a carry output of selected duration; and second AND gate means enabled by said flip flop means set output to conduct said carry output as said selected duration enabling pulse to said AND gate means.

5. Apparatus as set forth in claim 4 which is further characterized to include:

reset means providing a reset pulse to each of said flip flop means, decade counter means, second flip flop means, binary counter means and up/down counter means upon cessation of enablement of said AND gate means.

6. Apparatus as set forth in claim 4 wherein said alarm means comprises:

transistor means rendered conductive in response to said event count output; and relay means actuated by said transistor means conduction to provide alarm indication.

* * * * *